United States Patent [19]

Hellin

[11] 4,386,770

[45] Jun. 7, 1983

[54] NEEDLE FOR AUTOMATICALLY HANDLING LAYERS OF MATERIAL

[76] Inventor: Jean P. Hellin, Chemin des Cretes, Les Bourgailles, I3820 Ensues la Redonne, France

[21] Appl. No.: 201,034

[22] Filed: Oct. 27, 1980

[30] Foreign Application Priority Data

Oct. 26, 1979 [FR] France ..... 79 26955
May 6, 1980 [FR] France ..... 80 10648

[51] Int. Cl.[3] ..... B65H 3/22; B65H 3/48

[52] U.S. Cl. ..... 271/18.3; 271/97; 294/61; 294/100; 414/908

[58] Field of Search ..... 271/18.3, 19, 20, 18, 271/24, 21, 22, 23, 25, 97, 105, 1, 168, 141, 104, 195; 294/61, 100; 221/213, 214, 215, 216; 414/908, 116

[56] References Cited

U.S. PATENT DOCUMENTS 3,583,698 6/1971 Morton ..... 271/19
3,588,091 6/1971 Stone et al. ..... 271/19
3,595,562 7/1971 Oldroyd ..... 271/98
3,744,788 7/1973 Parker et al. ..... 271/105 X

FOREIGN PATENT DOCUMENTS 2650861 11/1978 Fed. Rep. of Germany .
2218417 9/1974 France .
2249008 5/1976 France .

*Primary Examiner*—Bruce H. Stoner, Jr.
*Attorney, Agent, or Firm*—Sandler & Greenblum

[57] ABSTRACT

Automated handling of fabrics and similar materials is accomplished by an apparatus which includes a first and second container. A pair of hollow and flexible needles are fixed within the first container and a pair of grooves for guiding movement of the needles are located within the second container. The second container is screwably attached to the first container. By screwing the two containers towards one another the points of the needles from the first container will be brought into the grooves or passageways of the second container and eventually will protrude outwardly from the bottom of the second container and extend into one or more layers of material to be separated or removed from a greater number of such layers.

5 Claims, 6 Drawing Figures

NEEDLE FOR AUTOMATICALLY HANDLING LAYERS OF MATERIAL

BACKGROUND OF THE INVENTION

1. Technical Field of the Invention

The present invention generally relates to a selecting needle for selecting one or more layers of material or the like.

It is adapted to separate and to manually or automatically handle one or more thicknesses of piled and compacted materials.

2. Discussion of Prior Art

There exist numerous devices utilizing the projection of opposed needles to separate and select layers of materials, but none which permit practical usage in which material damage is avoided. Such damage can be caused by separating stapled points, and especially by separating areas in which material resistance created by vacuum effects and static adhesion, which is due to the spacing of material surfaces pressed against one another, exists.

It is an object of the present invention to eliminate these inconveniences and to make it possible to adjust the depth of the penetration of the needles, to bring gripping elements together which do not project except through a single bore, and especially to overcome resistance to the separation which is created both by any vacuum effect and by static electricity.

The invention comprises a combination of hollow needles respectively blowing air through a single bore to achieve material separation while reducing the deteriorating effect normally caused by gripping elements.

BRIEF DESCRIPTION OF THE DRAWINGS

In the annexed drawings, given by way of non-limiting example, one embodiment of the invention is illustrated in which.

DETAILED DESCRIPTION OF THE DRAWINGS

Figure 1:
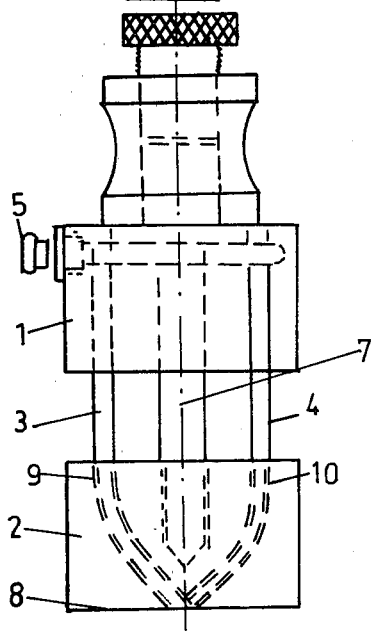
FIG. 1 shows the apparatus in elevation and in cross-section while in its rest position.
Figure 2:
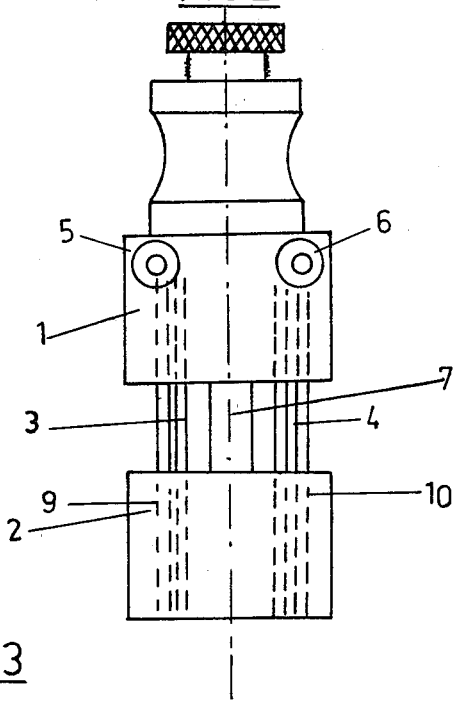
FIG. 2 is a profile view of the apparatus of FIG. 1.
Figure 3:
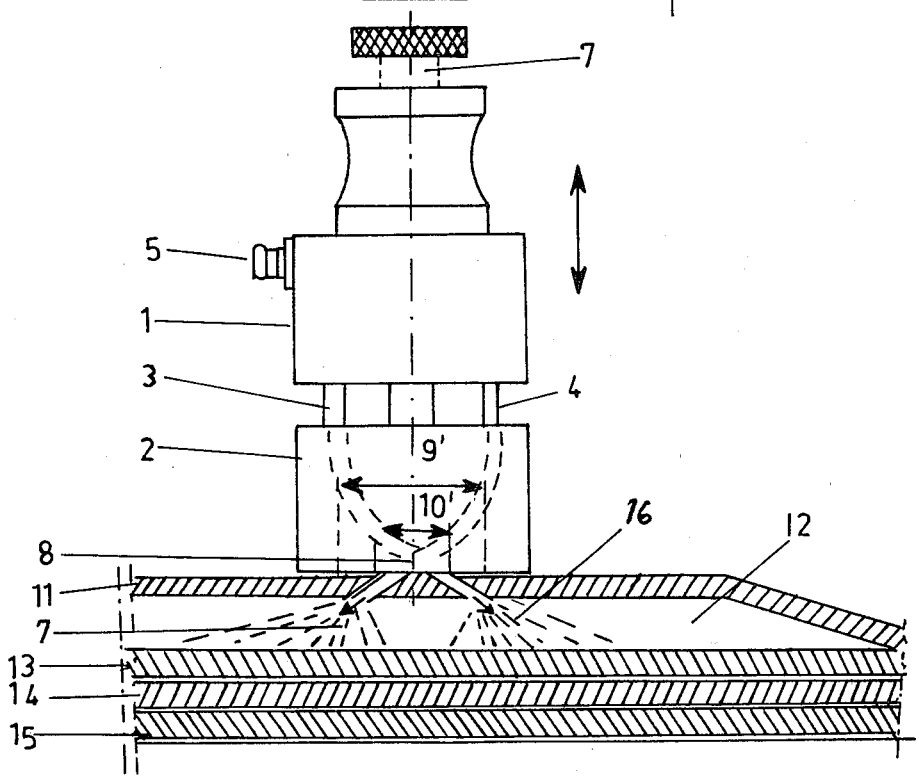
FIG. 3 shows the hollow needles engaged in material at a moment when the material is being raised.

The apparatus comprises first and second containers 1 and 2, respectively (see FIGS. 1, 2 and 3). The containers position the needles 3 and 4, which are blocked by screws 5 and 6, respectively, at their upper ends.

An adjustment screw 7 adjustably connects container 1 to container 2. This screw is adjustable during penetration of the needles into the material and makes it possible to select one or more layers of material and separate them from a pile of material layers.

Container 2 comprises first and second passages 9 and 10 which are positioned as part of the arc of a circle or obliquely and which serve to guide the needles, which are adapted to project symmetrically in opposite directions while they penetrate into material, as long as pressure is exerted on container 1, which is moved closer to container 2.

The material surfaces are adhered by the pressure which they exert against each other.

Such adherence is aggravated or increased by the static effects.

Resistance is eliminated by the use of hollow needles 3 and 4 which make it possible to blow atmospheric air into an empty space; this air is preferably pressurized.

Needles 3 and 4 pass through the layer of material 11 and project air into empty space 12, which air is dispersed from points 16, which permits separation of layer 11 from pieces 13, 14 and 15.

The crossing point 8 of the needles, which intersect obliquely within the material, causes gripping of material to occur very close to the layer 11 to be raised; accordingly, gripping will be perfect even if the material is elastic or soft, because according to FIG. 3, the approach represented by extensions 9' and 10', to which the material must be subjected to remove it, is maximal. The crossing point 8 of the needles also comprises the bore through which they extend, as best seen in FIG. 3. This bore is located at the intersection of passageways 9 and 10.

The selector needle is utilizable in series and makes it possible to completely automate handling of the material.

Figure 4:
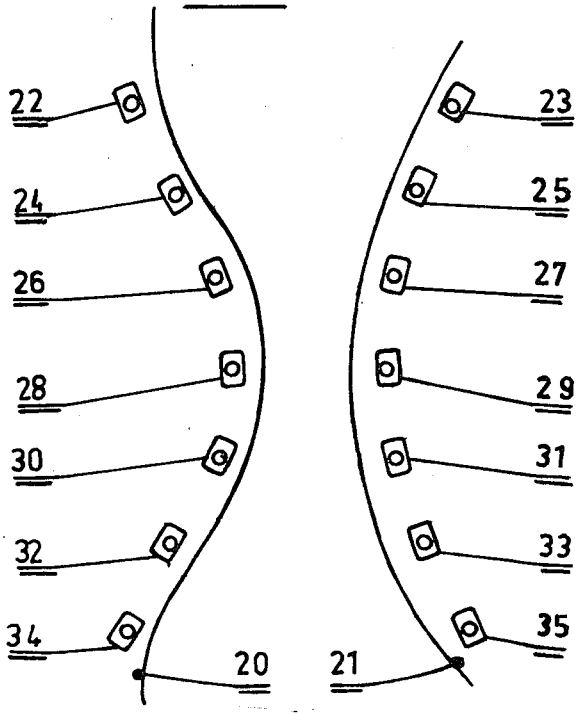
FIG. 4 is a planar schematic view of an example of a series of the apparatus in use for the automated assembly of two pieces of material.

FIG. 4 illustrates two pieces of material which are cut into shaped portions 20 and 21, and which are to be assembled. Lines of needles 22, 24, 26, 28, 30, 32, and 34, and 23, 25, 27, 29, 31, 33, and 35, respectively, are positioned along the borders of the pieces. Material layers 20 and 21 are all gathered in automatic fashion.

Figure 5:
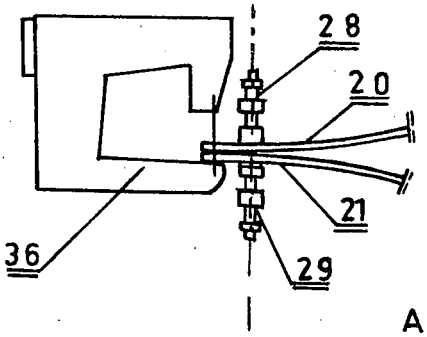
FIG. 5 shows, in elevation, two pieces of material positioned automatically in an assembler machine.

These apparatus lines are conventionally used to guide and present materials 20 and 21 to assembly machine 36 (See FIG. 5).

Figure 6:
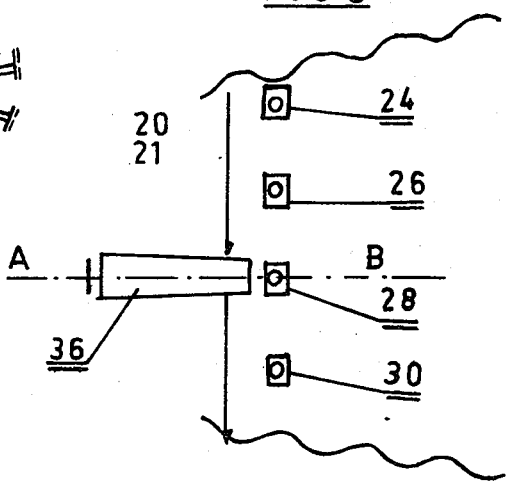
FIG. 6 is a planar view of FIG. 5.

FIG. 6 is a planar view which shows the formation of curves in the material during passage through the assembly machine.

I claim:

1. A needle selector assembly for separating one or more layers of material from a pile of a plurality of layers of the material, said assembly comprising first and second hollow curved needles and a container assembly for housing said needles, said container assembly including a single bore and comprising a first, upper container attached to a second, lower container by an adjustable screw, said first container retaining said needles, said second container comprising first and second curved passageways adapted to receive and guide said needles when said containers are moved towards one another by adjustment of said screw, said needles adapted to project outwardly from said bore into said pile of layers of material to comprise means for directing air between material layers.

2. A needle assembly in accordance with claim 1 wherein each of said curved passageways has the configuration of an arc of a circle.

3. A needle assembly in accordance with claim 1 wherein said passageways are obliquely positioned with respect to one another and intersect adjacent to said single bore, said single bore being located at the bottom of said second container.

4. A needle assembly in accordance with claim 1 wherein said needles are attached to said upper container by screws.

5. A needle assembly for handling and separating a predetermined number of layers of fabric from a plurality of layers of fabric, said assembly comprising:

(a) a lower container having an upper surface, a lower surface and a single bore adjacent a medial portion of said lower surface, said lower container further comprising first and second passageways extending in symmetrically opposite directions from the upper surface of said lower container to a point adjacent to the bottom surface of said lower container and adjacent to said single bore;

(b) an upper container fixedly housing first and second hollow, curved needles which are secured to an upper portion of said upper container by screws; and (c) an adjustment screw connecting said first container to said second container and extending beyond an upper surface of said first container, whereby said adjustment screw can be turned so as to selectively bring said first and second containers closer to one another or space them farther apart from one another, so that when said containers are brought towards one another by movement of said adjustment screw, said curved needles will move through respective passageways in said lower container and extend outwardly through said bore beyond the bottom surface of said lower container, such that when layers of material are positioned below said bottom surface of said lower container said needles will penetrate through one or more layers of material, and whereby said needles are adapted to introduce atmospheric air between said layers of material into which said needles penetrate.

* * * * *